US007015903B2

(12) United States Patent
Lee

(10) Patent No.: US 7,015,903 B2
(45) Date of Patent: Mar. 21, 2006

(54) LIQUID CRYSTAL DISPLAY DEVICE AND DRIVING METHOD THEREOF

(75) Inventor: Moo Jin Lee, Daegu-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 300 days.

(21) Appl. No.: 09/892,662

(22) Filed: Jun. 28, 2001

(65) Prior Publication Data

US 2002/0027540 A1 Mar. 7, 2002

(30) Foreign Application Priority Data

Sep. 2, 2000 (KR) ..... P2000-51886

(51) Int. Cl.
*G09G 5/00* (2006.01)

(52) U.S. Cl. ..... 345/212; 345/90; 345/92; 345/99

(58) Field of Classification Search ..... 345/87, 345/88, 89, 92, 94, 98, 103, 204, 90, 99, 345/211–213
See application file for complete search history.

(56) References Cited

U.S. PATENT DOCUMENTS 5,604,511 A * 2/1997 Ohi ..... 345/98
5,748,169 A * 5/1998 Okumura et al. ..... 345/100
5,798,740 A * 8/1998 Bitzakidis et al. ..... 345/92
5,977,940 A * 11/1999 Akiyama et al. ..... 345/94
6,456,268 B1 * 9/2002 Takeda ..... 345/92
6,522,318 B1 * 2/2003 Kumagawa et al. ..... 345/98
6,525,720 B1 * 2/2003 Baek ..... 345/213
6,680,722 B1 * 1/2004 Hiraki et al. ..... 345/96
6,741,229 B1 * 5/2004 Yanagi et al. ..... 345/98

* cited by examiner

*Primary Examiner*—Henry N. Tran
(74) *Attorney, Agent, or Firm*—McKenna Long & Aldridge LLP

(57) ABSTRACT

A liquid crystal display device and a driving method thereof wherein a change in a charge rate of a thin film transistor compensates for an externally applied frequency variation upon driving of the liquid crystal display device so as to improve the picture quality. In the device, a timing controller receiving control signals from a host system. A frequency detector is connected to either the input terminal or the output terminal of the timing controller to detect the control signals. A compensation voltage setting part compensates for the driving voltage in response to the control signals detected from the frequency detector so as to adjust a charge time of each thin film transistor. A voltage converter generates a compensation voltage set by the compensation voltage setting part to deliver the compensation voltage to a liquid crystal display panel. Accordingly, the common voltage and/or the gate high voltage, changed in accordance with an extremely applied frequency variation, are set to optimum values and thus are compensated so that a constant picture quality can be maintained irrespectively of such a frequency variation.

6 Claims, 9 Drawing Sheets

LIQUID CRYSTAL DISPLAY DEVICE AND DRIVING METHOD THEREOF

CROSS REFERENCES TO RELATED APPLICATIONS

This application claims benefit of Korean Patent Application No. P2000-51886, filed on Sep. 2, 2000, the entirety of which is hereby incorporated by reference for all purposes as if fully set forth herein.

BACKGROUND OF THE INVENTION

1. Field of the Invention

This invention relates to a liquid crystal display (LCD), and more particularly to a liquid crystal display device wherein a change in a charge rate of a thin film transistor is compensated in a frequency variation applied from the exterior thereof upon driving of the liquid crystal display device so as to improve a picture quality. The present invention also is directed to a method of driving said liquid crystal display device.

2. Description of the Related Art

Generally, a liquid crystal display device has an inherent resolution corresponding to the number of integrated pixels, and has a higher resolution as its dimension becomes larger. In order to display a high quality of picture, makers of the liquid crystal display device increase a pixel integration ratio within a liquid crystal panel among liquid crystal display devices having the same dimension for the purpose of differentiating the resolution.

The standards of image signals and control signals in the case of a personal computer, etc., including the liquid crystal display device along with the resolution were established by the Video Electronics Standard Association (VESA) in February 1989.

The typical standards of display devices being commercially available in the current display industry include DOS Mode (640×350, 640×400, 720×400), VGA (640×400), SVGA (800×600), XGA (1024×768), SXGA (1280×1024) and UXGA (1600×1200) Modes, etc.

The LCD has a resolution fixed depending on the number of arranged pixels and hence requires image signals conforming to a resolution of the liquid crystal display panel and control signals for the image signal from the system. Accordingly, the system converts image signals and control signals corresponding to various display standards into image signals and control signals complying with a resolution and a display standard of the LCD using a scaler chip and the like and applies the same to the LCD.

FIG. 1 is a block diagram showing a configuration of the conventional LCD. In FIG. 1, an interface 10 receives data (e.g., RGB data) and control signals (e.g., an input clock, a horizontal synchronizing signal, a vertical synchronizing signal and a data enable signal) and applies them to a timing controller 12. A low voltage differential signal (LVDS) interface and a transistor transistor logic (TTL) interface, etc., have been mainly used for data and control signal transmission to the driving system. All of such interfaces are integrated into a single chip along with the timing controller 12.

The timing controller 12 uses a control signal input via the interface 10 to produce control signals for driving a data driver 18 consisting of a plurality of driver ICs (not shown) and a gate driver 20 consisting of a plurality of gate driver ICs (not shown). Also, the timing controller 12 transfers data input from the interface 10 to the data driver 18.

The data driver 18 selects reference voltages in accordance with the input data in response to control signals from the timing controller 12 to convert the same into an analog image signal and applies the converted signal to a liquid crystal panel 22. The gate driver 20 performs an on/off control of gate terminals of thin film transistors (TFTs) 23 (i.e.,switching devices) arranged on the liquid crystal panel 22, one scan line 24 at a time, in response to the control signals input from the timing controller 12. Also, the gate driver 20 allows the analog image signals from the data driver 18 to be applied to each pixel connected to each TFT 23 via a data line 25.

A direct current (DC) voltage to DC voltage converter 14 applies a gate high voltage (Vgh) for driving the TFTs within the liquid crystal display panel 22 to the gate driver 20, and generates a common electrode voltage Vcom for the liquid crystal display panel 22 to apply it to the gate driver 20. The standards of said voltages are established by a manufacturer on the basis of the transmissivity to voltage characteristic of the panel.

However, the LCD also has employed various display formats from the VGA class to the UXGA class. Signals input to the timing controller differ depending on the various display formats. In other words, a main clock or a frame frequency input to the interface is different depending on various display formats set in accordance with the resolution. Accordingly, a charge characteristic of the TFT provided within the liquid crystal display panel becomes different, and hence flicker and gray scale characteristics, etc. becomes different, to thereby change a picture quality.

This will be described by an example shown in FIG. 2. In FIG. 2, when a gate high voltage (Vgh) applied to the TFT has a constant value of 18V, a common voltage Vcom also has a constant value of 5V and a frame frequency is changed from 50 Hz to 60 Hz, a charge time T of the TFT is decreased from 22 $\mu$s (T1) to 18 $\mu$s (T2) and, at the same time, a gate voltage width Gw is decreased from Gw1 to Gw2. Thus, a data pulse applied to the TFT fails to reach a saturation state to cause a discharge. Therefore, the TFT fails to make a sufficient discharge to reduce the charge rate and generate a variation in a picture quality.

As described above, the conventional LCD applies a constant high voltage Vgh and a constant common electrode voltage Vcom from the DC to DC voltage converter to the TFT's provided within the liquid crystal display panel even though a main clock or a frame frequency differ in accordance with various display formats set depending on the resolution that is input thereto. Thus, a charge rate of the TFT is changed and a flicker, etc. is generated, to thereby cause a deterioration of picture quality.

SUMMARY OF THE INVENTION

Accordingly, it is an object of the present invention to provide a liquid crystal display device and a driving method thereof wherein a change in a charge rate of a thin film transistor is compensated for a frequency variation applied from the exterior thereof upon driving of the liquid crystal display device so as to improve a picture quality.

In order to achieve these and other objects of the invention, a liquid crystal display device according to one aspect of the present invention includes a timing controller for receiving control signals transmitted from a host system; a frequency detector connected to either an input terminal or an output terminal of the timing controller to detect the transmitted control signals; compensation voltage setting means for compensating the driving voltage in response to the control signals detected from the frequency detector so as to assure a charge time of each thin film transistor; and a voltage converter for generating a compensation voltage set by the compensation voltage setting means to deliver the compensation voltage to a liquid crystal display panel.

A method of controlling a liquid crystal display device according to another aspect of the present invention includes the steps of detecting control signals from any one of an input terminal and an output terminal of a timing controller receiving the control signals from a host system; setting a compensation voltage for compensating the driving voltage in response to the detected control signals so as to assure a charge time of each thin film transistor; and generating the set compensation voltage to deliver it to a liquid crystal display panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
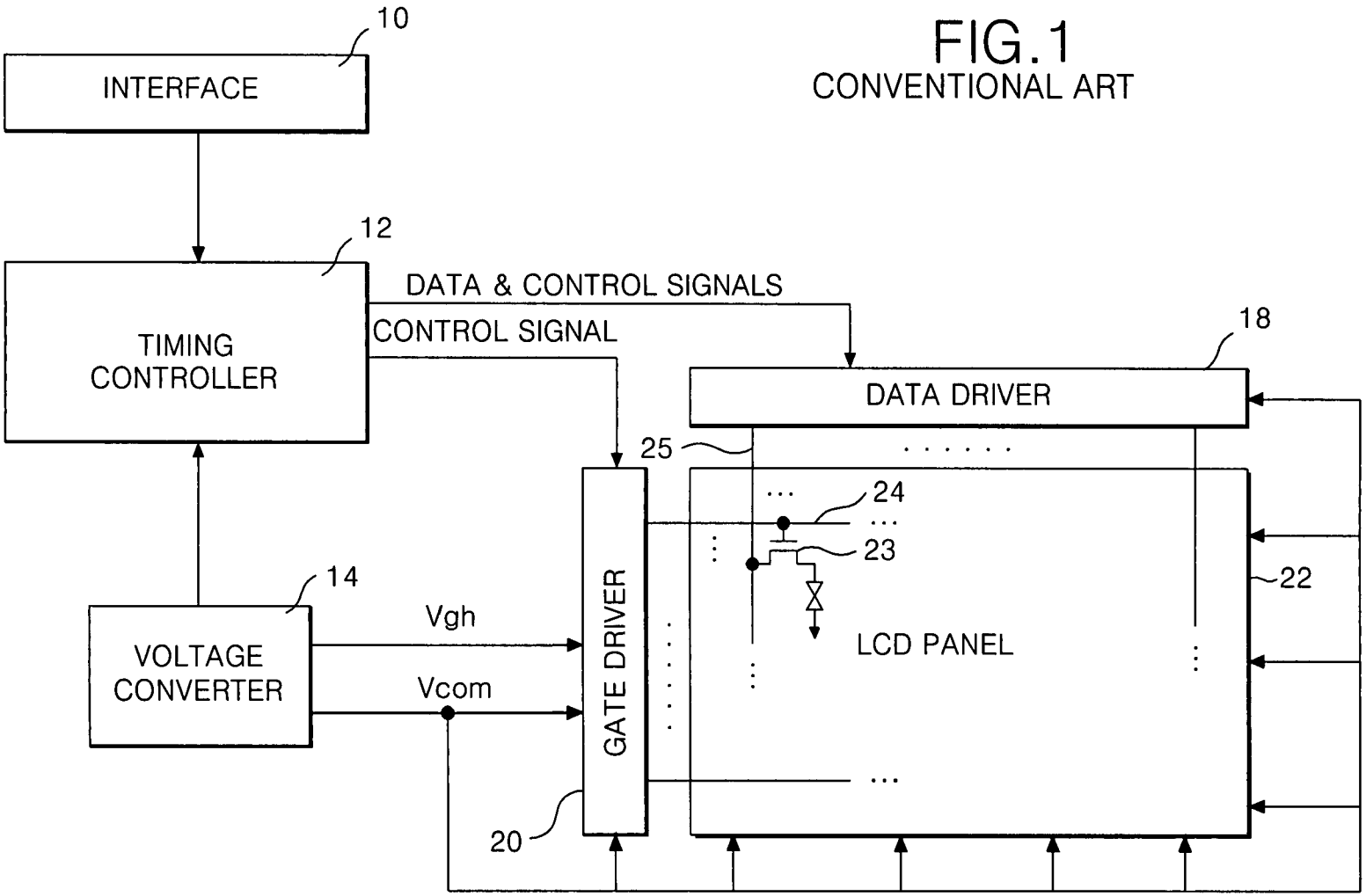
FIG.1 CONVENTIONAL ART
FIG. 1 is a block diagram showing a configuration of a conventional liquid crystal display device.
Figure 3:
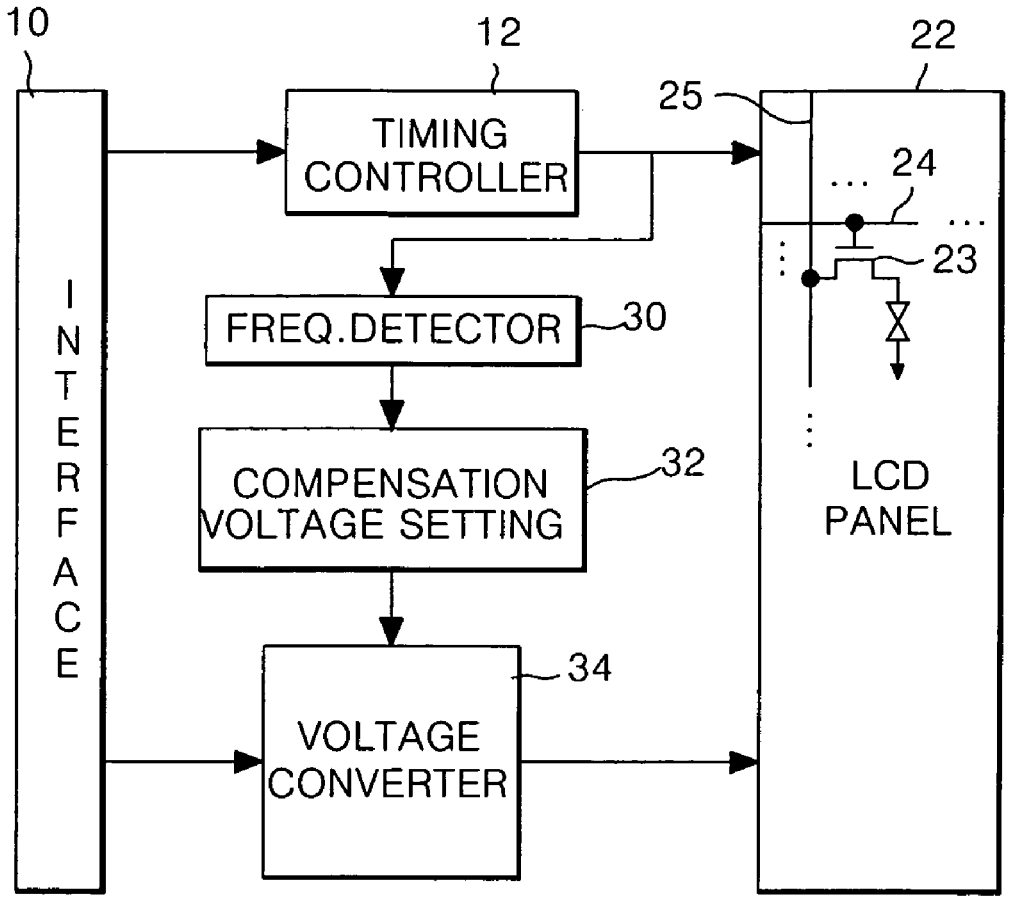
FIG. 3 is a schematic block diagram showing a configuration of a driving circuit for a liquid crystal display device according to a first embodiment.

FIG. 3 is a block diagram of a driving circuit for a liquid crystal display device according to a first embodiment. The interface, the timing controller, the voltage converter and the liquid crystal display panel in FIG. 3 are identical to those of the driving circuit in FIG. 1. Therefore, said elements in FIG. 3 are given by the same reference numerals as those in FIG. 1.

Referring to FIG. 3, the liquid crystal display device according to the first embodiment includes an interface 10 for receiving and transferring data (e.g., RGB data) and control signals (e.g., an input clock, a horizontal synchronizing signal, a vertical synchronizing signal and a data enable signal) input from a driving system such as a personal computer, a timing controller 12 for generating control signals for driving a data driver 18 consisting of a plurality of data driving ICs (not shown) and a gate driver 20 consisting of a plurality of gate driving ICs (not shown) using the control signals input via the interface 10, a frequency detector 30 for detecting frequencies of the control signals output to the output terminal of the timing controller 12, a compensation voltage setting part 32 for retrieving and comparing the frequencies detected from the frequency detector 30 to generate a control signal for setting a compensation voltage according to said frequencies, a voltage converter 34 for generating a desired gate high voltage Vgh for raising and lowering a reference voltage Vin from the interface 10 using the control signal from the compensation voltage setting part 32 to deliver the same to the gate driver, and a liquid crystal display panel 22 driven with the gate high voltage Vgh and a data signal applied from the gate driver 20 and the data driver 18, respectively.

The frequency detector 30 receives the control signals (e.g., a vertical synchronizing signal and a data signal) from the timing controller 12 via an output transmission line of the timing controller 12 and sends them to the compensation voltage setting part 32. The compensation voltage setting part 32 retrieves the control signals from the frequency detector 30, and generates a control signal for setting a compensation voltage for the gate high voltage Vgh so as to sufficiently drive the TFTs provided within the liquid crystal display panel 22 in response to the retrieved control signals to deliver the same to the voltage converter 34. The voltage converter 34 raises or lowers a reference voltage Vin from the interface 10 by the control signal from the compensation voltage setting part 32 to generate a compensation voltage sufficient to drive the TFTs, and delivers the compensation voltage to the liquid crystal display panel 22.

Figure 4:
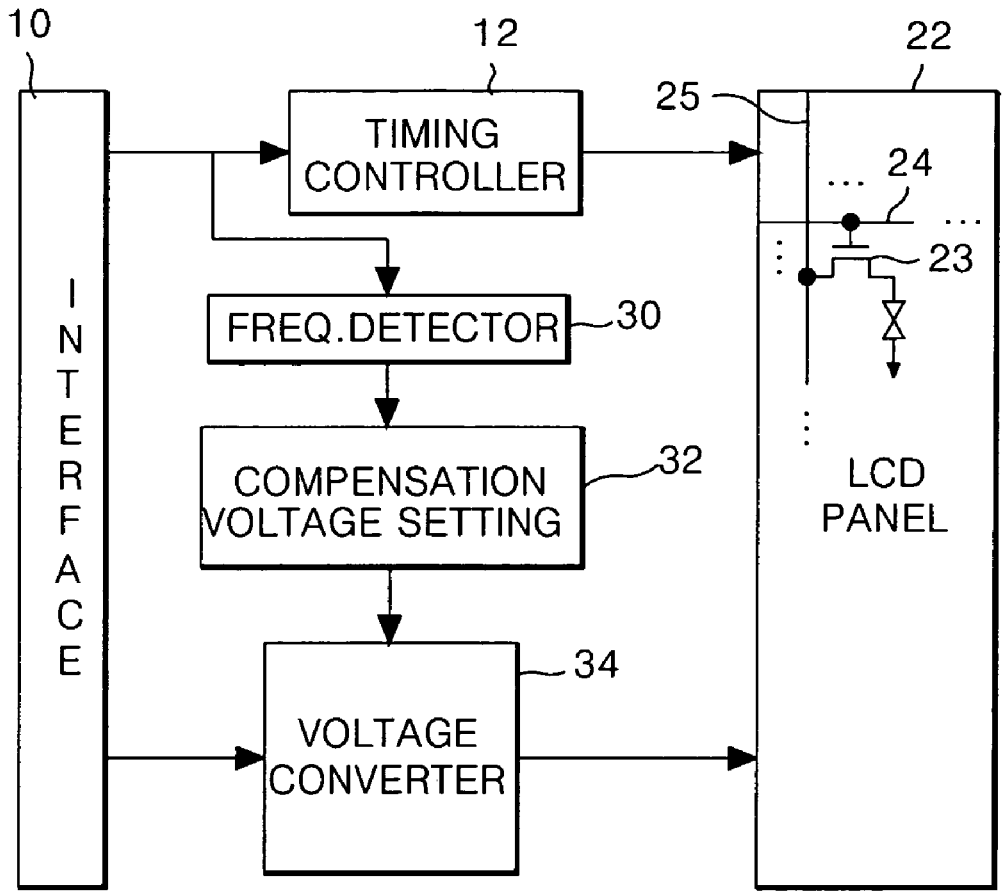
FIG. 4 is a schematic block diagram showing a configuration of a driving circuit for a liquid crystal display device according to a second embodiment.

FIG. 4 is a block diagram of a driving circuit for a liquid crystal display device according to a second embodiment. The driving circuit in FIG. 4 has the same driving characteristic as that in FIG. 3. except that the frequency detector detects the control signals input to the timing controller from the input terminal of the timing controller rather than detecting the control signals from the output terminal of the timing controller.

Since the driving circuit for the liquid crystal display device according to the second embodiment shown in FIG. 4 has the same driving characteristic as the driving circuit shown in FIG. 3, a detailed explanation as to the driving circuit for the liquid crystal display device according to the second embodiment will be omitted.

Driving characteristics of the driving circuits for the liquid crystal display devices shown in FIG. 3 and FIG. 4 will be described in conjunction with an example shown in FIG. 2 below.

Figure 2:
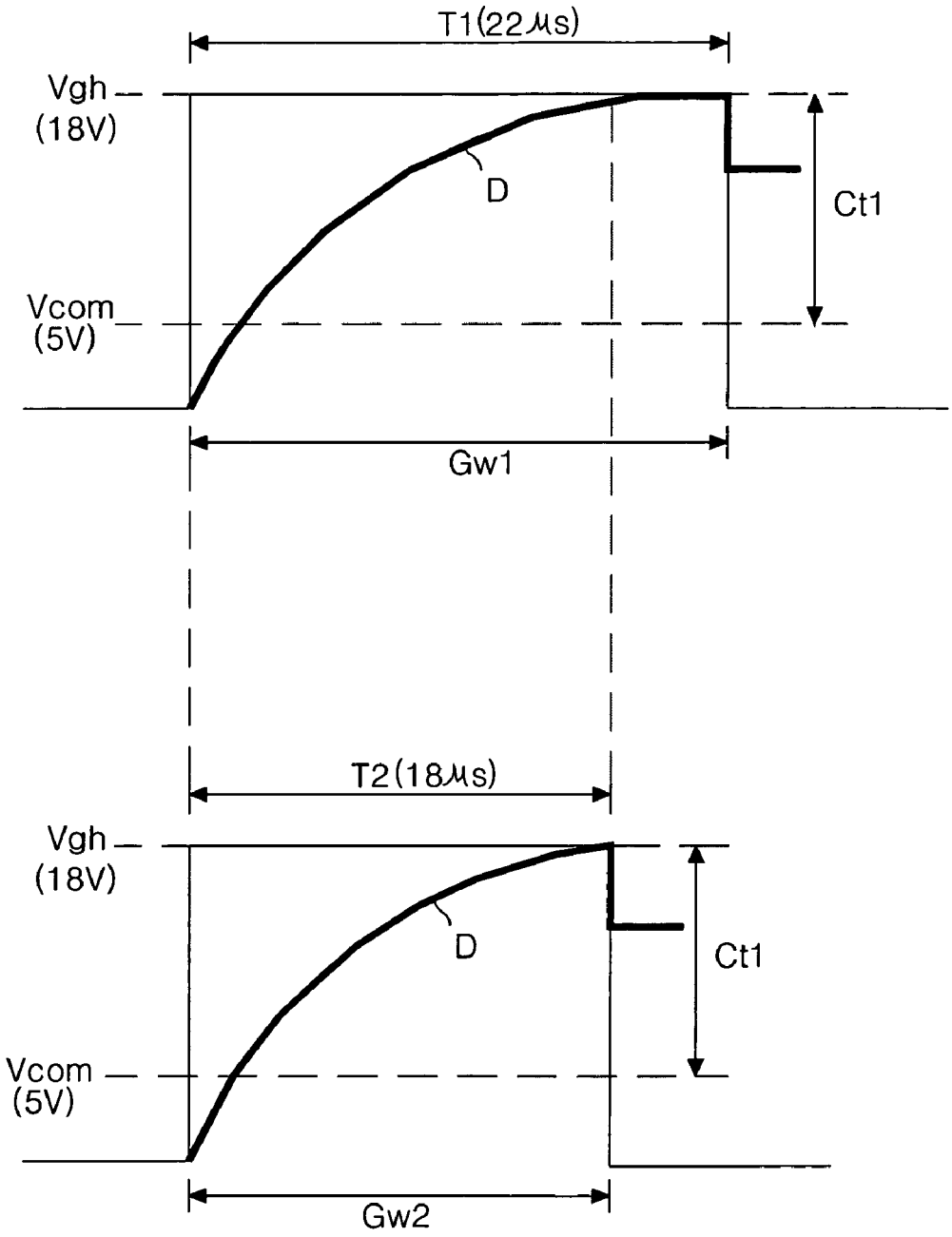
FIG.2 CONVENTIONAL ART
FIG. 2 illustrates the time-varying amplitude of a gate high voltage and a common electrode voltage applied to the TFT in FIG. 1.

As shown in FIG. 2, when a gate high voltage (Vgh) is 18V, a common voltage Vcom is 5V and a frame frequency of 50 Hz set to achieve an optimum charge characteristic is changed into 60 Hz, a charge time T of the TFT is decreased from 22 $\mu$s (T1) to 18 $\mu$s (T2) and, at the same time, a gate voltage width Gw is decreased from Gw1 into Gw2. Thus, a time period for sufficiently charging the TFT is reduced.

Figure 5:
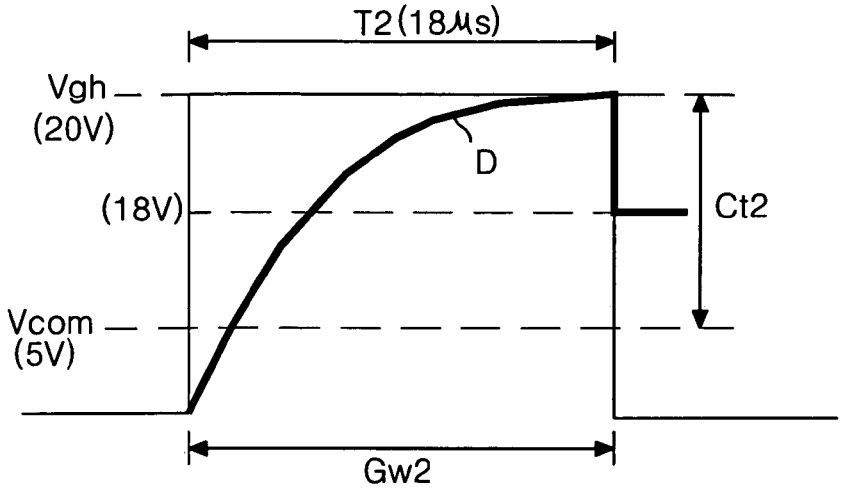
FIG. 5 is a graph for explaining a TFT charge compensation employing the driving circuits shown in FIG. 3 and FIG. 4.

In order to solve this problem, the frequency detector 30 as shown in FIG. 3 or FIG. 4 detects the control signals input to or output from the timing controller 12 and delivers the detected control signals to the compensation voltage setting part 32. The compensation voltage setting part 32 sets an appropriate compensation voltage so that the TFT can obtain an optimum charge rate, as shown in FIG. 5. In this case, the charge rate of the TFT is compensated by increasing the gate high voltage Vgh to 20V. In other words, the gate high voltage Vgh is increased to lengthen a charged region Ct2. Accordingly, the charged region Ct2 of the TFT is sufficiently lengthened, so that an optimum charge rate can be obtained.

Figure 6:
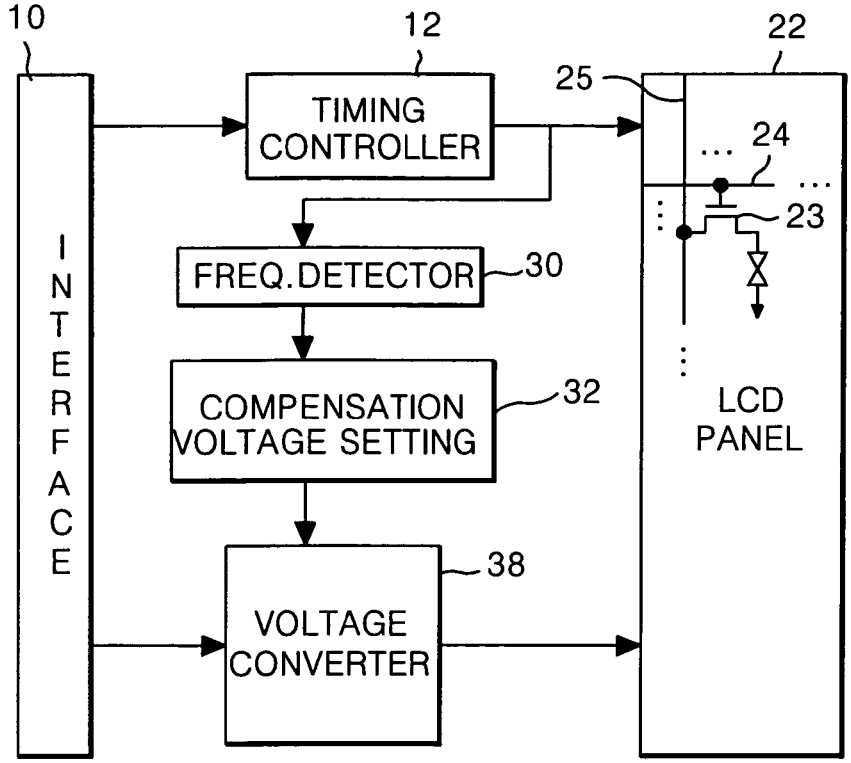
FIG. 6 is a schematic block diagram showing a configuration of a driving circuit for a liquid crystal display device according to a third embodiment.

FIG. 6. is a block diagram of a driving circuit for a liquid crystal display device according to a third embodiment. The driving circuit in FIG. 6 has the same driving characteristic as that in FIG. 3. except that the compensation voltage setting part sets a compensation voltage for compensating for a common voltage Vcom and the voltage converter generates the compensation voltage set by the compensation voltage setting part to apply it to the liquid crystal display panel. Therefore, only the compensation voltage setting part and the DC to DC converter being different from those in FIG. 3 will be described.

As shown in FIG. 6, the compensation voltage setting part 32 retrieves control signals from the frequency detector 30, and generates a control signal for setting a compensation voltage for a common voltage Vcom so as to sufficiently drive the TFTs provided within the liquid crystal display panel 22 in response to the retrieved control signals to deliver the same to voltage converter 38. The voltage converter 38 raises or lowers a reference voltage Vin from the interface 10 by the control signal from the compensation voltage setting part 32 to generate a compensation voltage sufficient to drive the TFTs, and delivers the compensation voltage to the liquid crystal display panel 22.

Figure 7:
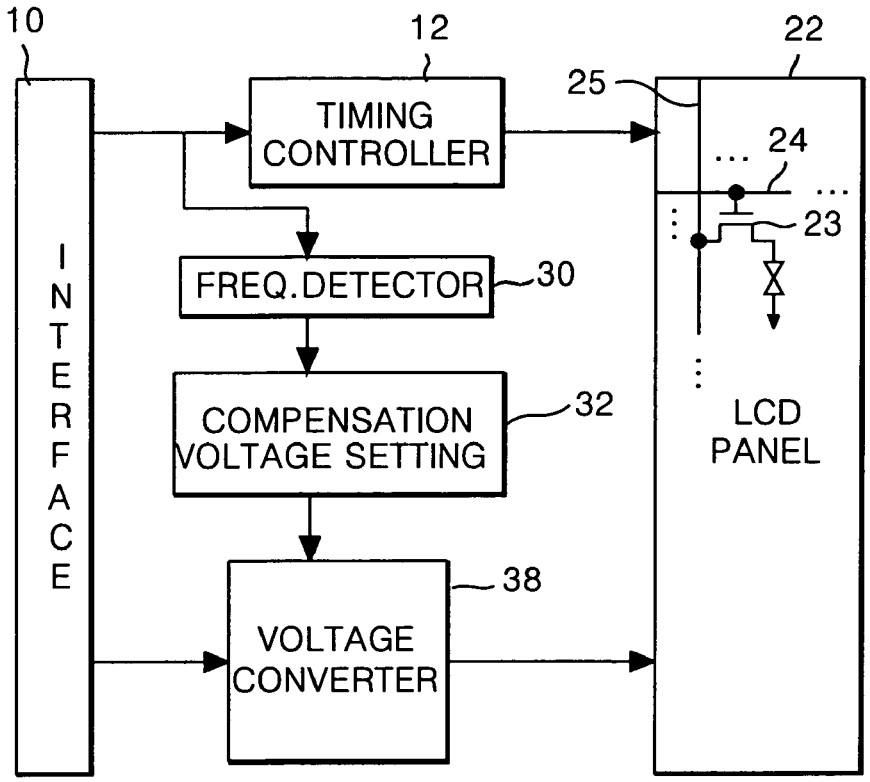
FIG. 7 is a schematic block diagram showing a configuration of a driving circuit for a liquid crystal display device according to a fourth embodiment.

FIG. 7 is a block diagram of a driving circuit for a liquid crystal display device according to a fourth embodiment. The driving circuit in FIG. 7 has the same driving characteristic as that in FIG. 6. except that the frequency detector detects the control signals inputted to the timing controller from the input terminal of the timing controller rather than detecting the control signals from the output terminal of the timing controller.

Since the driving circuit for the liquid crystal display device according to the fourth embodiment shown in FIG. 6 has the same driving characteristic as the driving circuit shown in FIG. 6, a detailed explanation as to the driving circuit for the liquid crystal display device according to the fourth embodiment will be omitted.

Driving characteristics of the driving circuits for the liquid crystal display devices shown in FIG. 6 and FIG. 7 will be described in conjunction with an example shown in FIG. 2 below.

As shown in FIG. 2, when a gate high voltage (Vgh) is 18V, a common voltage Vcom is 5V and a frame frequency of 50 Hz set to achieve an optimum charge characteristic is changed into 60 Hz, a charge time T of the TFT is decreased from 22 $\mu$s (T1) to 18 $\mu$s (T2) and, at the same time, a gate voltage width Gw is decreased from Gw1 to Gw2. Thus, the time for sufficiently charging the TFT is reduced.

Figure 8:
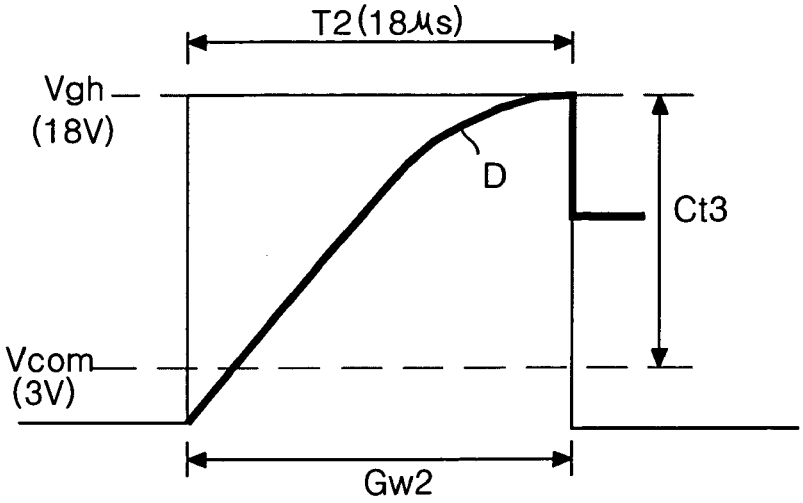
FIG. 8 is a graph for explaining a TFT charge compensation employing the driving circuits shown in FIG. 6 and FIG. 7.

In order to solve this problem, the frequency detector 30 as shown in FIG. 6 or FIG. 7 detects the control signals input to, or output from, the timing controller 12 and delivers the detected control signals to the compensation voltage setting part 32. The compensation voltage setting part 32 sets an appropriate compensation voltage so that the TFT can obtain an optimum charge rate as shown in FIG. 8. In this case, the charge rate of the TFT is compensated by decreasing the common voltage Vcom to 3V. In other words, the common voltage Vcom is reduced to lengthen a region Ct3. Accordingly, the charged region Ct3 of the TFT is sufficiently lengthened, so that an optimum charge rate can be obtained.

Figure 9:
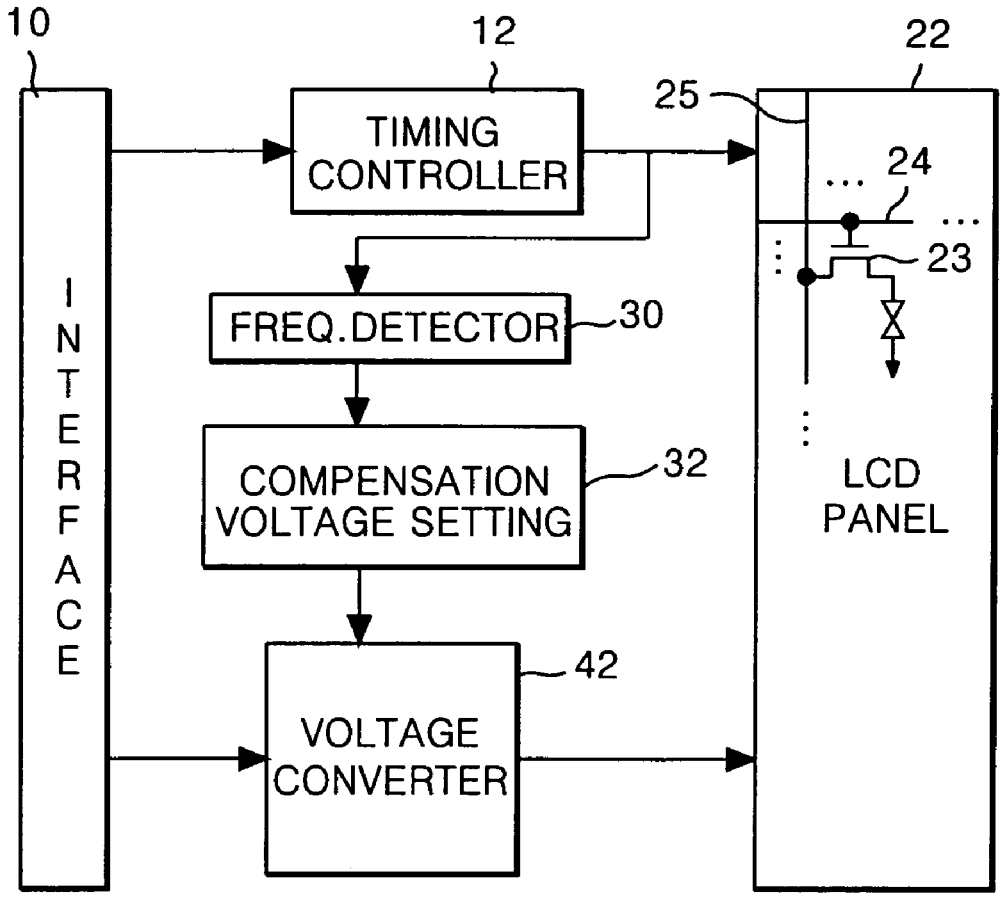
FIG. 9 is a schematic block diagram showing a configuration of a driving circuit for a liquid crystal display device according to a fifth embodiment.

FIG. 9 is a block diagram of a driving circuit for a liquid crystal display device according to a fifth embodiment of the present invention. The driving circuit in FIG. 9 has the same driving characteristic as that in FIG. 3 or FIG. 6, except that the compensation voltage setting part sets a compensation voltage for compensating for a gate high voltage Vgh and a common voltage Vcom and the voltage converter generates the compensation voltage set by the compensation voltage setting part to apply it to the liquid crystal display panel. Therefore, only the compensation voltage setting part and the voltage converter being different from those in FIG. 3 or FIG. 6 will be described.

As shown in FIG. 9, the compensation voltage setting part 32 retrieves control signals from the frequency detector 30, and generates a control signal for setting a compensation voltage for a gate high voltage Vgh and a common voltage Vcom so as to sufficiently drive the TFTs provided within the liquid crystal display panel 22 in response to the retrieved control signals to deliver the same to a voltage converter 42. The voltage converter 42 heightens and/or lowers a reference voltage Vin from the interface 10 by the control signal from the compensation voltage setting part 32 to generate a compensation voltage enough to drive the TFTs, and delivers the compensation voltage to the liquid crystal display panel 22.

Figure 10:
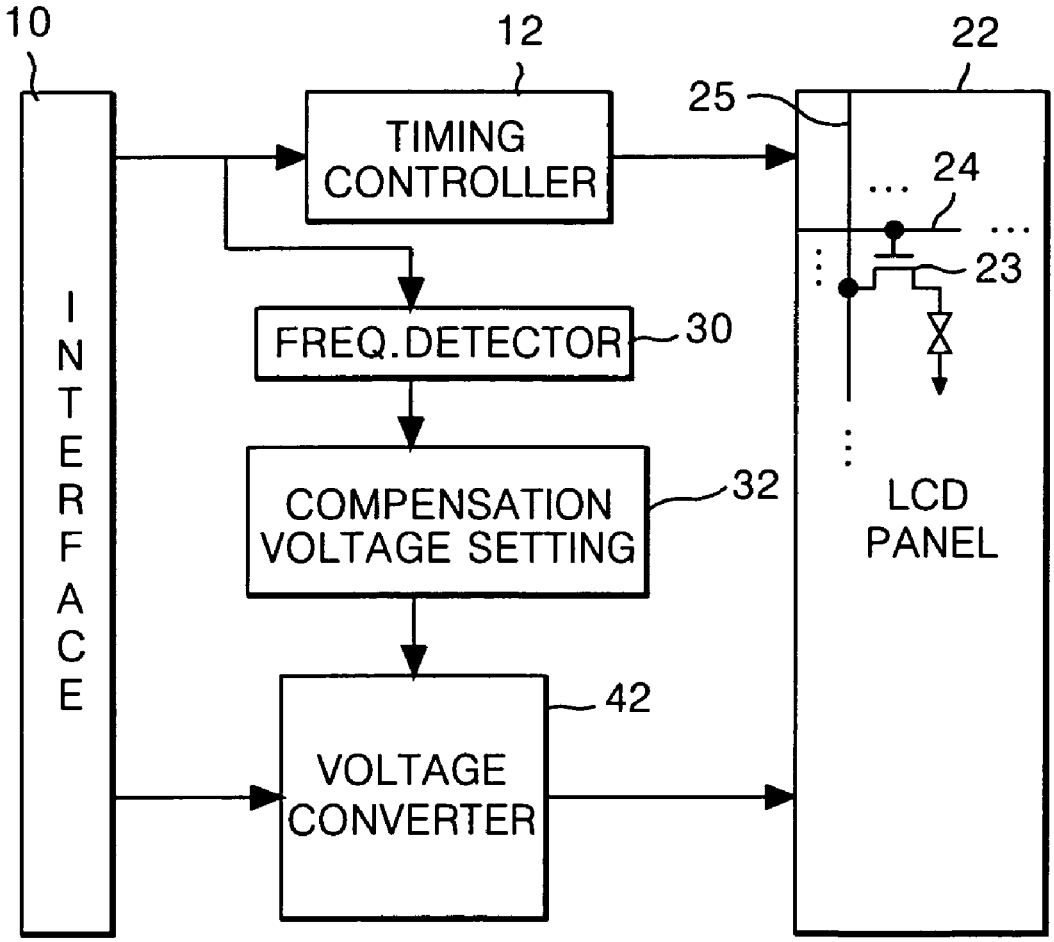
FIG. 10 is a schematic block diagram showing a configuration of a driving circuit for a liquid crystal display device according to a sixth embodiment.

FIG. 10 is a block diagram of a driving circuit for a liquid crystal display device according to a sixth embodiment of the present invention. The driving circuit in FIG. 10 has the same driving characteristic as that in FIG. 9, except that the frequency detector detects the control signals input to the timing controller from the input terminal of the timing controller rather than detecting the control signals from the output terminal of the timing controller.

Since the driving circuit for the liquid crystal display device according to the sixth embodiment shown in FIG. 10 has the same driving characteristic as the driving circuit shown in FIG. 9, a detailed explanation as to the driving circuit for the liquid crystal display device according to the sixth embodiment will be omitted.

Driving characteristics of the driving circuits for the liquid crystal display devices shown in FIG. 9 and FIG. 10 will be described in conjunction with an example shown in FIG. 2 below.

As shown in FIG. 2, when a gate high voltage (Vgh) is 18V, a common voltage Vcom is 5V and a frame frequency of 50 Hz set to achieve an optimum charge characteristic is changed into 60 Hz, a charge time T of the TFT is decreased from 22 $\mu$s (T1) to 18 $\mu$s (T2) and, at the same time, a gate voltage width Gw is decreased from Gw1 to Gw2. Thus, a time for sufficiently charging the TFT is reduced.

Figure 11:
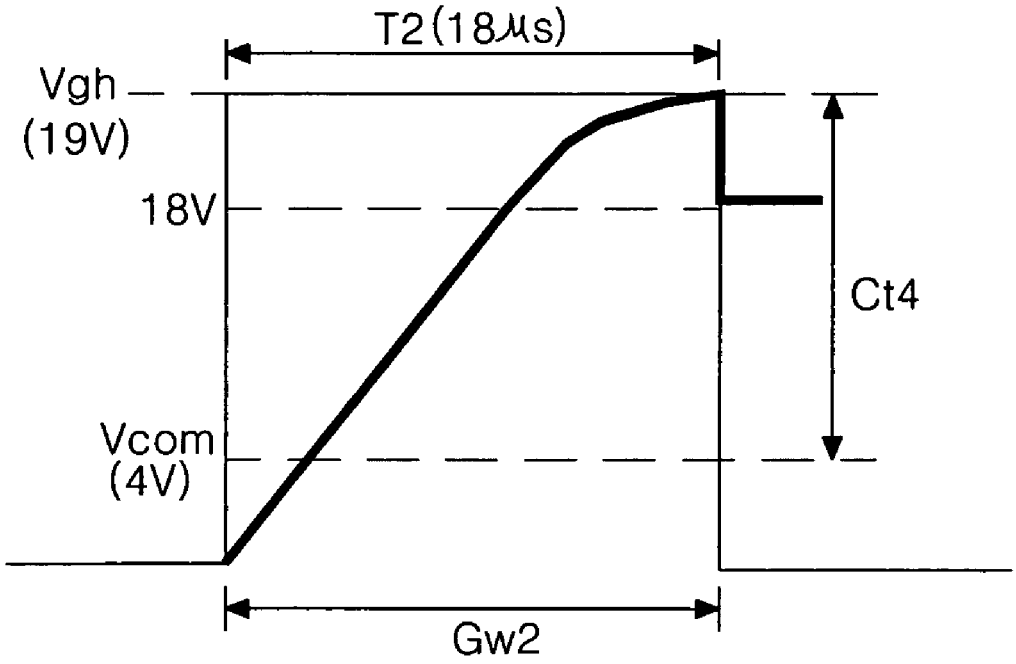
FIG. 11 is a graph for explaining a TFT charge compensation employing the driving circuits shown in FIG. 9 and FIG. 10.

In order to solve this problem, the frequency detector 30 as shown in FIG. 9 or FIG. 10 detects the control signals input to or output from the timing controller 12 and delivers the detected control signals to the compensation voltage setting part 32. The compensation voltage setting part 32 sets an appropriate compensation voltage so that the TFT can obtain an optimum charge rate as shown in FIG. 11. In this case, the charge rate of the TFT is compensated by resetting the gate high voltage Vgh to 19V and the common voltage Vcom to 3V. In other words, the gate high voltage Vgh is heightened while the common voltage Vgh is lowered to lengthen a charged region Ct4. Accordingly, the charged region Ct4 of the TFT is sufficiently lengthened, so that an optimum charge rate can be obtained.

As described above, according to the present invention, the common voltage and/or the gate high voltage, changed in accordance with an extremely applied frequency variation, are set to optimum values and thus are compensated so that a constant picture quality can be maintained irrespectively of such a frequency variation.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device including a liquid crystal display panel provided with thin film transistors comprising:

a timing controller having an input terminal for receiving control signals transmitted from a host system, wherein the timing controller further includes an output terminal;

a frequency detector connected to the input terminal or the output terminal of the timing controller to detect the transmitted control signals;

compensation voltage setting means connected to an output terminal of the frequency detector, wherein the compensation voltage setting means receives the control signals detected by the frequency detector and generates a compensation voltage control signal based on the detected control signals; and a voltage converter connected to an output terminal of the compensation voltage setting means and to the liquid crystal display panel, the voltage converter generating a compensation voltage based on the compensation voltage control signal and a driving voltage output by the host system so as to adjust a charge time of the thin film transistors and delivering the compensation voltage to the liquid crystal display panel.

2. The liquid crystal display device as claimed in claim 1, wherein said compensation voltage is any one of a gate high voltage and a common voltage of the thin film transistors.

3. The liquid crystal display device as claimed in claim 1, wherein said compensation voltage includes a gate high voltage and a common voltage of the thin film transistor.

4. A method of controlling a liquid crystal display device including a liquid crystal display panel provided with thin film transistors, the method comprising:

detecting the presence of control signals at one of an input terminal and an output terminal of a timing controller receiving the control signals from a host system;

generating a compensation control signal in response to the detected control signals;

adjusting a driving voltage output by the host system based on the compensation control signal, thereby generating a compensation voltage so as to adjust a charge time of the thin film transistors; and delivering the compensation voltage to the liquid crystal display panel.

5. The method as claimed in claim 4, wherein said compensation voltage, is any one of a gate high voltage and a common voltage of the thin film transistor.

6. The method as claimed in claim 4, wherein said compensation voltage includes a gate high voltage and a common voltage of the thin film transistor.

* * * * *